US008257116B2

(12) United States Patent
Zhu et al.

(10) Patent No.: US 8,257,116 B2
(45) Date of Patent: Sep. 4, 2012

(54) AUDIO JACK CONNECTOR WITH AN IMPROVED CONTACT ARRANGEMENT

(75) Inventors: Zi-Qiang Zhu, Kunshan (CN); Xiao-Peng Yu, Kunshan (CN); Hong-Qiang Han, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 208 days.

(21) Appl. No.: 12/839,430

(22) Filed: Jul. 20, 2010

(65) Prior Publication Data

US 2011/0014815 A1 Jan. 20, 2011

(51) Int. Cl.
*H01R 24/04* (2006.01)

(52) U.S. Cl. ..... 439/668; 439/541.5

(58) Field of Classification Search ..... 439/668–669, 439/188, 541.5

See application file for complete search history.

(56) References Cited

U.S. PATENT DOCUMENTS

| | | | | |
|---|---|---|---|---|
| 4,695,116 | A * | 9/1987 | Bailey et al. | 439/188 |
| 6,116,959 | A * | 9/2000 | Taylor | 439/668 |
| 7,484,996 | B2 * | 2/2009 | Ju | 439/541.5 |
| 7,878,864 | B2 * | 2/2011 | Wang et al. | 439/668 |
| 2008/0085613 | A1 | 4/2008 | Ju | |

* cited by examiner

*Primary Examiner* — Xuong Chung Trans

(74) *Attorney, Agent, or Firm* — Wei Te Chung; Andrew C. Cheng; Ming Chieh Chang

(57) ABSTRACT

An audio jack connector includes an insulative housing (1) having a main body (10) defining a pair of opposite front and rear faces (11, 12) and a pair of opposite first and second side walls (15, 16), a set of columned mating portions (17) extending forwardly on the front face, and a set of receiving chambers (111) extending in the main body and passing through the mating portions for insertion of plugs (200); and a plurality of contacts (3) retained in the first side wall and arranged in several different rows along a transverse direction so as to protrude into the receiving chambers respectively, each row of the contacts being arranged along a front-to-back direction in accordance with an insertion direction of the plug and perpendicular to the transverse direction.

13 Claims, 8 Drawing Sheets

AUDIO JACK CONNECTOR WITH AN IMPROVED CONTACT ARRANGEMENT

BACKGROUND OF THE INVENTION

1. Field of the Invention

The present invention relates to an audio jack connector, and more particularly to an audio jack connector with an improved contact arrangement.

2. Description of Related Art

A conventional audio jack connector usually comprises an insulative housing and a plurality of contacts retained therein. The insulative housing has a set of columned mating portions extending forwardly from a front face thereof and stacked in a row along a height direction of the audio jack connector, a set of receiving chambers extending in the insulative housing and passing through the mating portions for insertion of plugs. The contacts include several groups of contacts and are assembled to the insulative housing from a rear face of the insulative housing so as to protrude into the corresponding receiving chambers for contacting with the plugs. The contacts include contacting portions protruding into the corresponding receiving chambers, connecting portions extending downwardly from the contacting portions, and tail portions extending downwardly from the connecting portions for being mounted to a PCB. The connecting portions are exposed to the exterior when the contacts are assembled to the insulative housing. A spacer is further needed to be assembled to the rear face of the insulative housing to hold the connecting portions and the tail portions. The length of the audio jack along the front-to-back direction will be increased, and the volume of the audio jack will be enlarged.

Hence, an improved audio jack connector is desired to overcome the above problems.

BRIEF SUMMARY OF THE INVENTION

According to one aspect of the present invention, an audio jack connector comprises an insulative housing having a main body defining a pair of opposite front and rear faces and a pair of opposite first and second side walls, a set of columned mating portions extending forwardly on the front face, and a set of receiving chambers extending in the main body and passing through the mating portions for insertion of plugs; and a plurality of contacts retained in the first side wall and arranged in several different rows along a transverse direction so as to protrude into the receiving chambers respectively, each row of the contacts being arranged along a front-to-back direction in accordance with an insertion direction of the plug and perpendicular to the transverse direction.

According to another aspect of the present invention, a stacked audio jack connector comprises an insulative housing having a main body defining a pair of opposite front and rear faces and a pair of opposite first and second side walls, a set of columned mating portions extending forwardly on the front face and stacked in a row along a height direction of the audio jack connector, and a set of receiving chambers extending in the main body and passing through the mating portions for insertion of plugs; and a plurality of contacts assembled to the first side wall from an outer surface of the first side wall. The contacts include a set of longest contacts arranged in an outmost row along a front-to-back direction and defining highest contacting portions projecting into a highest receiving chamber for contacting with the plug, a set of lowest contacts arranged in an innermost side row along the front-to-back direction and defining lowest contacting portions projecting into a lowest receiving chamber for contacting with the plug, and a set of middle contacts arranged in a middle row along the front-to-back direction and located between the outmost row and the innermost row, the middle contacts defining middle contacting portions projecting into a middle receiving chamber for contacting with the plug and located between the highest contacting portions and the lowest contacting portions in the height direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
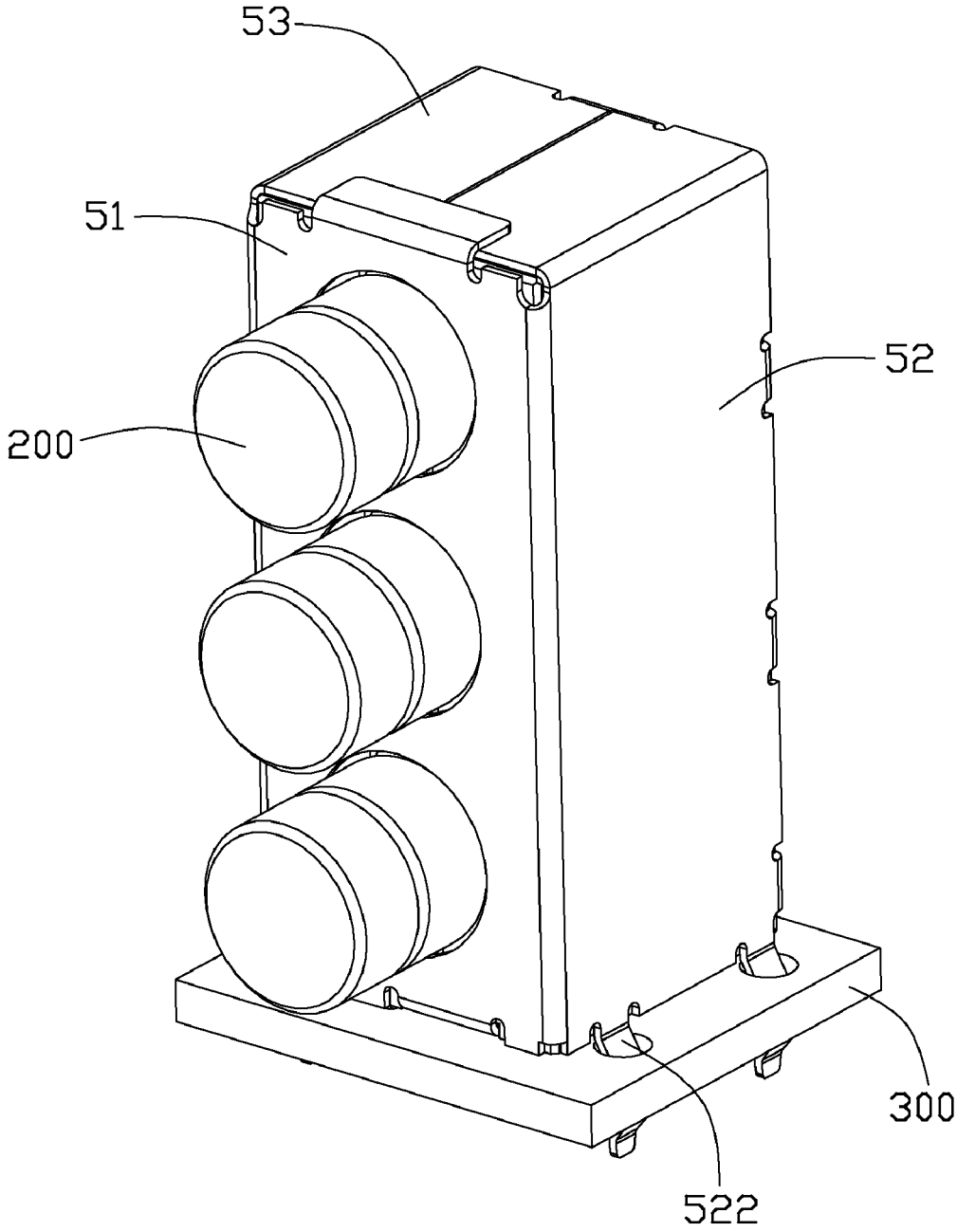
FIG. 1 is an assembled, perspective view of an audio jack connector according to the present invention for being mounted to a PCB.
Figure 2:
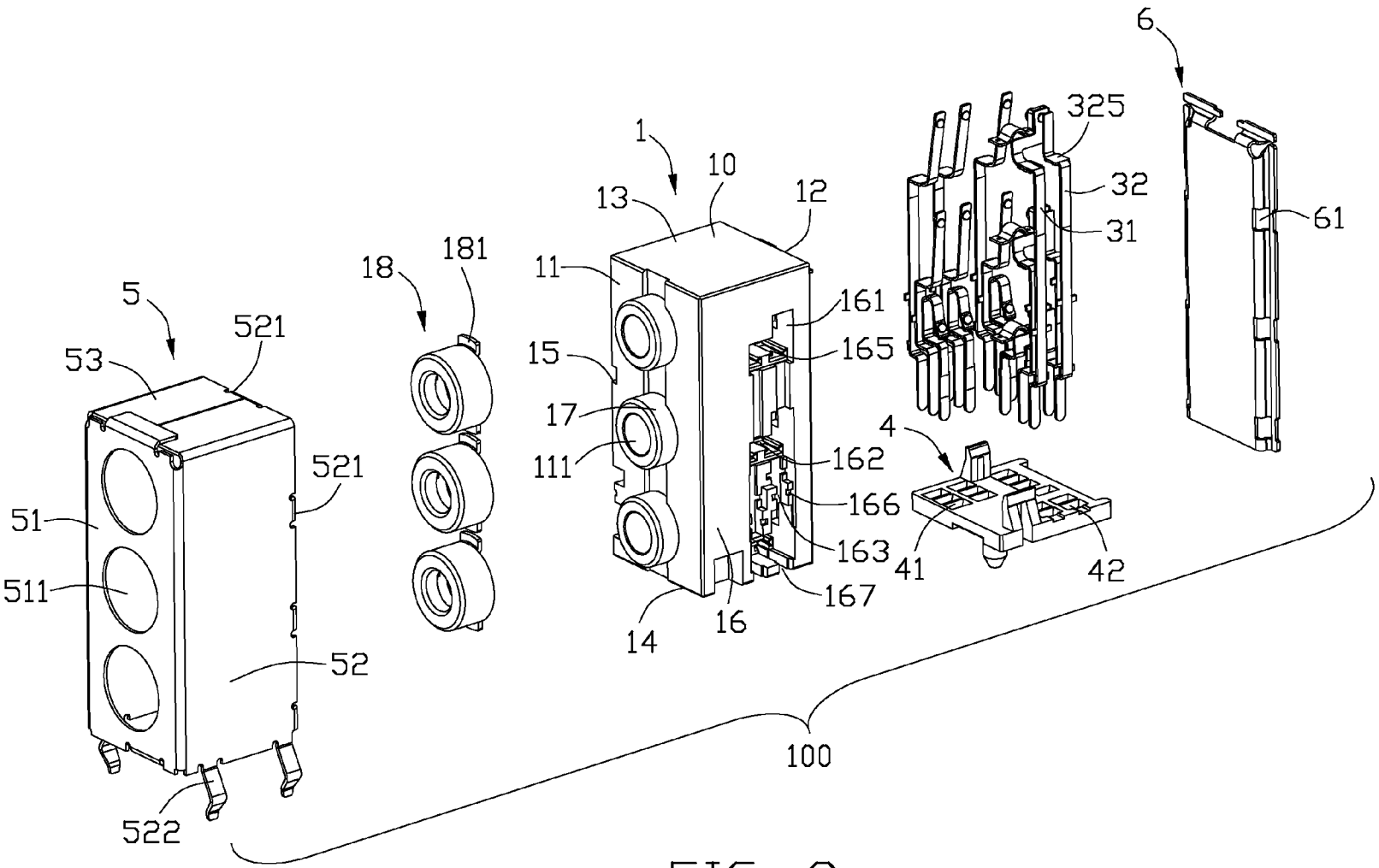
FIG. 2 is an exploded perspective view of the audio jack connector shown in FIG. 1.
Figure 3:
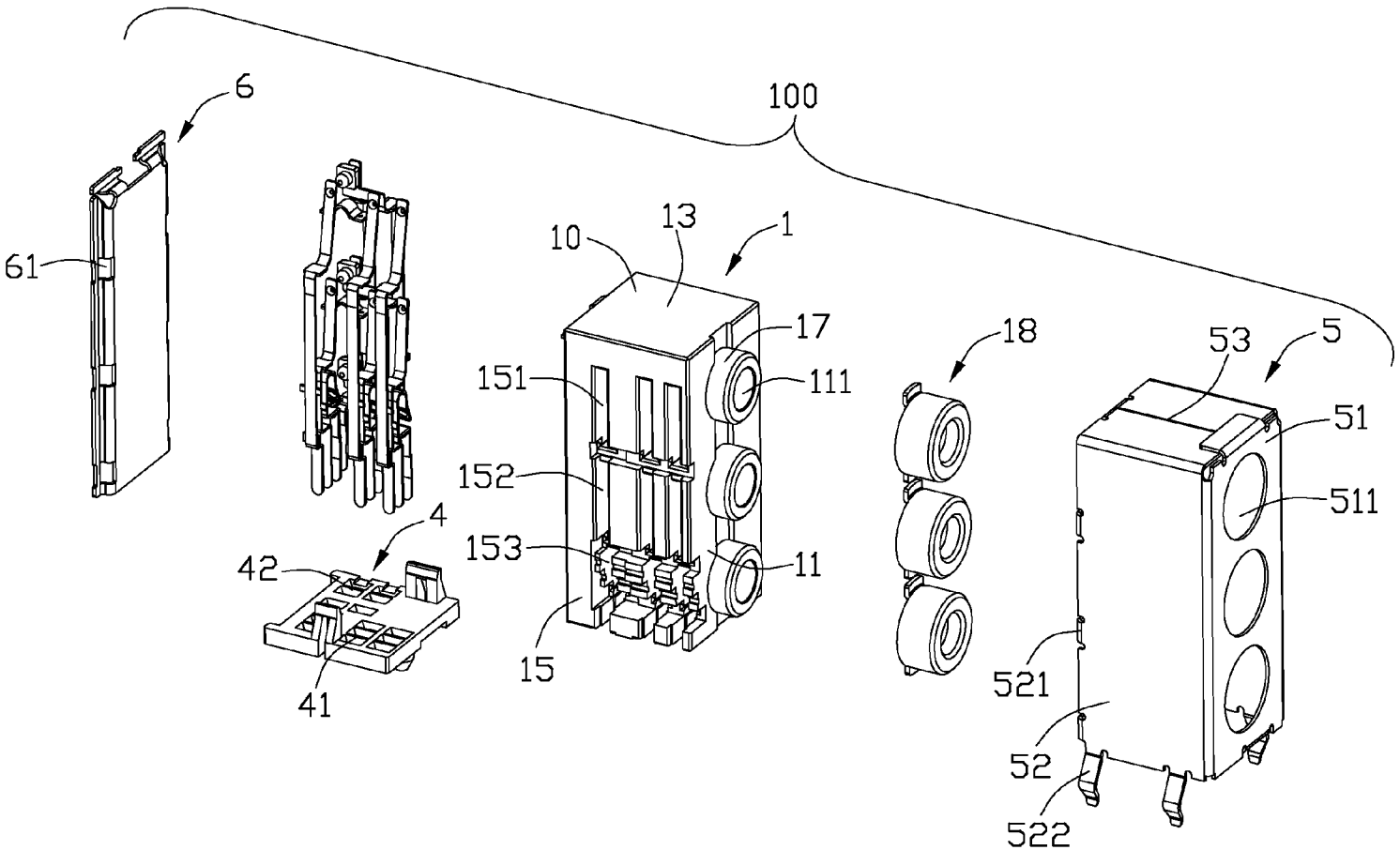
FIG. 3 is similar to FIG. 2, but viewed from another aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-8, an audio jack connector 100 according to an embodiment of the present invention is adapted for insertion of three identical audio plugs and comprises an insulative housing 1, a plurality of contacts 2 retained in one lateral side of the insulative housing 1, a plurality of detection switches 3 retained in another lateral side of the insulative housing 1, a plurality of enforcing members 101 retained in the insulative housing 1, a spacer 4 for positioning the contacts 2 and the switches 3, a shell 5 for shielding the insulative housing 1, and a rear cover 6 for latching with the shell 5.

Referring to FIGS. 2-8, the insulative housing 1 includes a rectangular main body 10 defining a front face 11, a rear face 12 opposite to the front face 111, a pair of opposite top and bottom faces 13, 14, and a pair of left and right side walls 15, 16 located at two lateral sides thereof, three columned mating portions 17 extending forwardly from the front face 11 of the main body 10 and stacked in a row along a height direction of the audio jack 100, and three receiving chambers 111 extending in the main body 10 and passing through the mating portions 17 in a front-to-back direction. The main body 10 has a set of recesses 19 recessed backwardly from the front face 11 and located at upper and lower sides of the mating portions 17. Three columnar bushings 18 are assembled to the main body 10 and envelope the three mating portions 17 respectively. Each columnar bushing 18 has a pair of projections 181 projecting therefrom and retained in the recesses 19 respectively. The left side wall 15 has a set of first receiving slots 151 arranged in an upper row, a set of second receiving slots 152 arranged in a middle row, and a set of third receiving slots 153 arranged in a lower row. The right side wall 16 has a pair of first receiving cavities 161 located in an upper position, a pair of second receiving cavities 162 located in a middle position, and a pair of third receiving cavities 163 located in a lower position. The right side wall 16 has a pair of second grooves 167 locating below the third receiving cavities 163 and passing downwardly through the bottom face 14. The first receiving slots 151, the second receiving slots 152, and the third receiving slots 153 communicates with the receiving chamber 111 via first, second, and third perforations 1511, 1521, 1531 formed on the left side wall 15.

The left side wall 15 has a first partition portion 1513 and a second partition portion 1523 partitioning the left side wall 15 into a first part 157, a second part 158, and a third part 159 for disposing the first receiving slots 151, the second receiving slots 152 and the third receiving slots 153 thereon respectively. The left side wall 15 has a set of first retaining slots 1512 formed on the first partition portions 1513 and communicating with the first receiving slots 151, a set of second retaining slots 1522 formed on the second partition portions 1523 and communicating with the second receiving slots 152, and a set of third retaining slots 1532 formed below the third receiving slots 153 and communicating with the third receiving slots 153. The third part 159 has a pair of first securing slots 155 and a pair of second securing slots 156 located at two lateral sides of each third receiving slot 153. The second securing slots 156 are located at lower and inner side of the first securing slots 155. The third part 159 has a set of first grooves 150 communicating with the retaining slots 1532 and passing downwardly through the bottom face 14. A set of ribs 154 are formed on the third part 159 and locates at two sides of each first groove 150.

Figure 4:
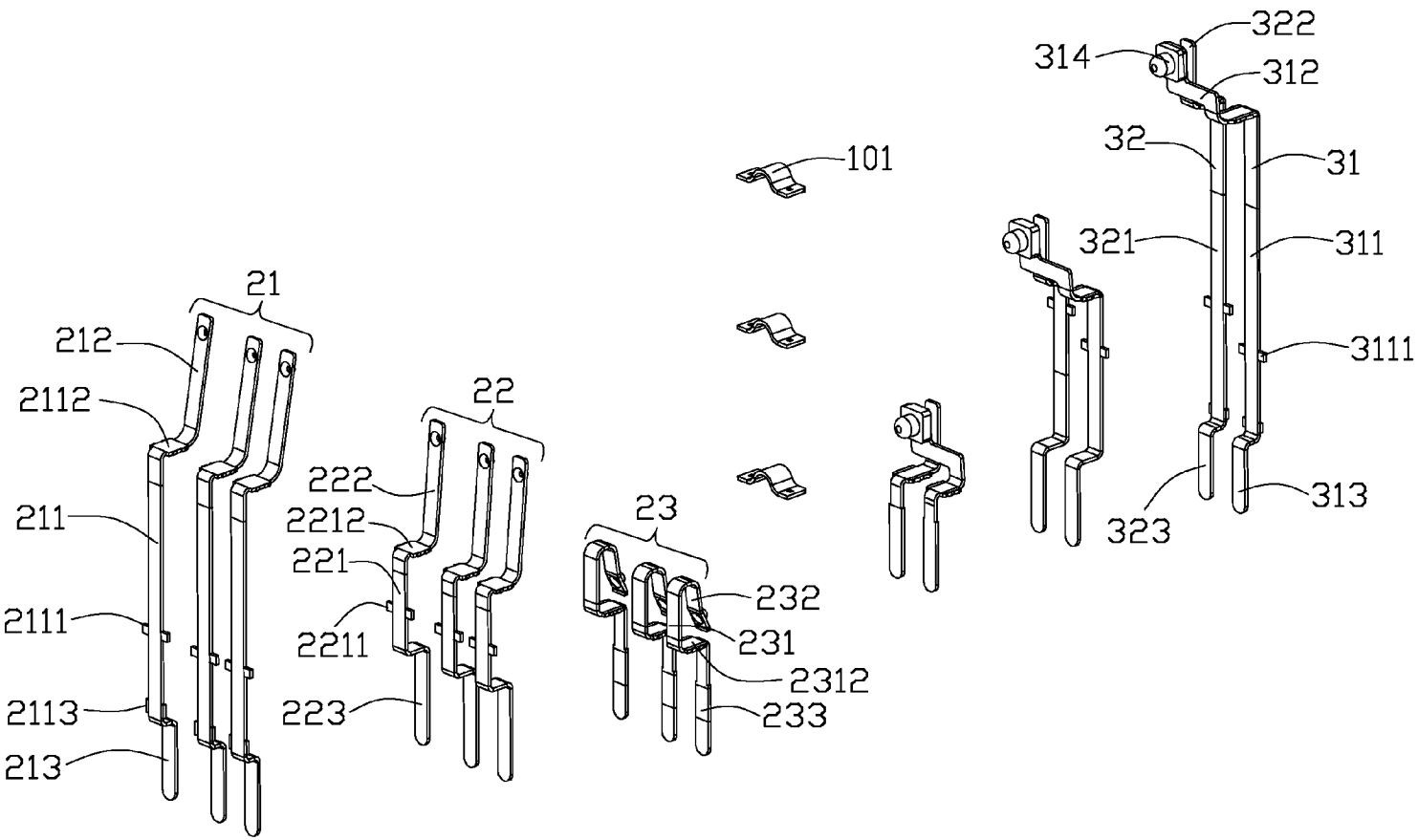
FIG. 4 is a perspective view of contacts, detection switches, and enforcing members of the connector shown in FIG. 1.
Figure 5:
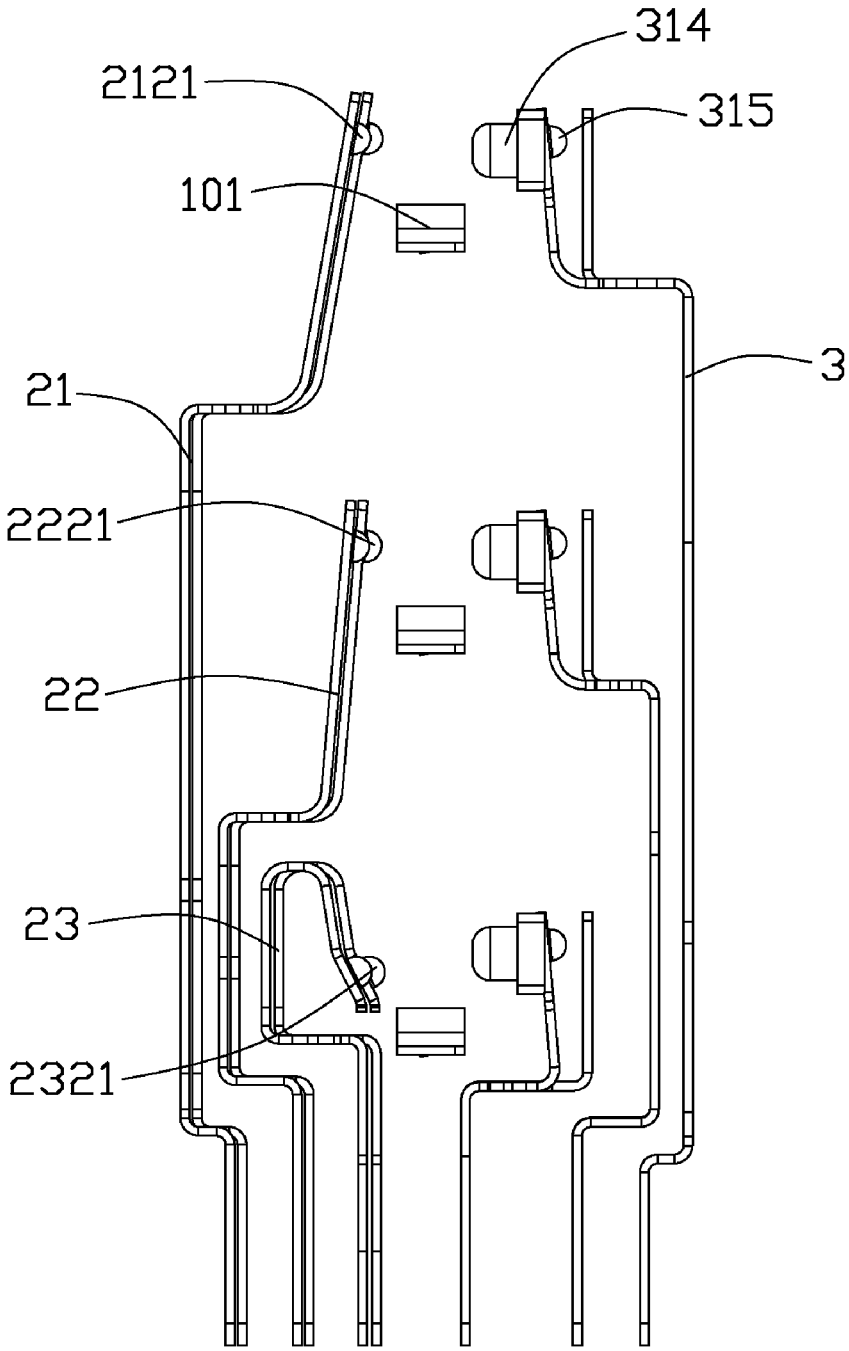
FIG. 5 is similar to FIG. 4, but viewed from another aspect.
Figure 6:
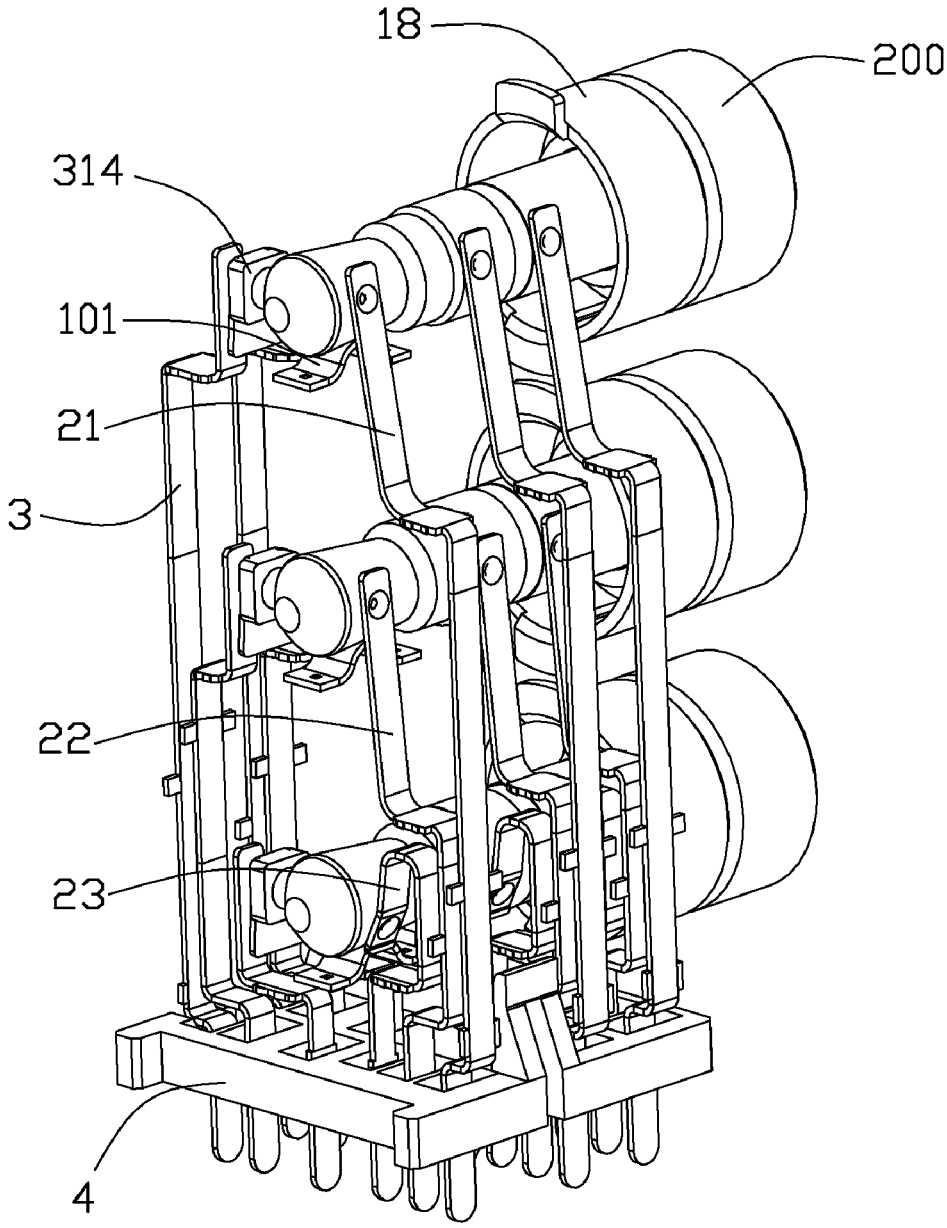
FIG. 6 is a perspective view showing the contacts, detection switches, and enforcing members of the connector mating with the plug, and a spacer of the connector retaining the contacts and the detection switches.
Figure 7:
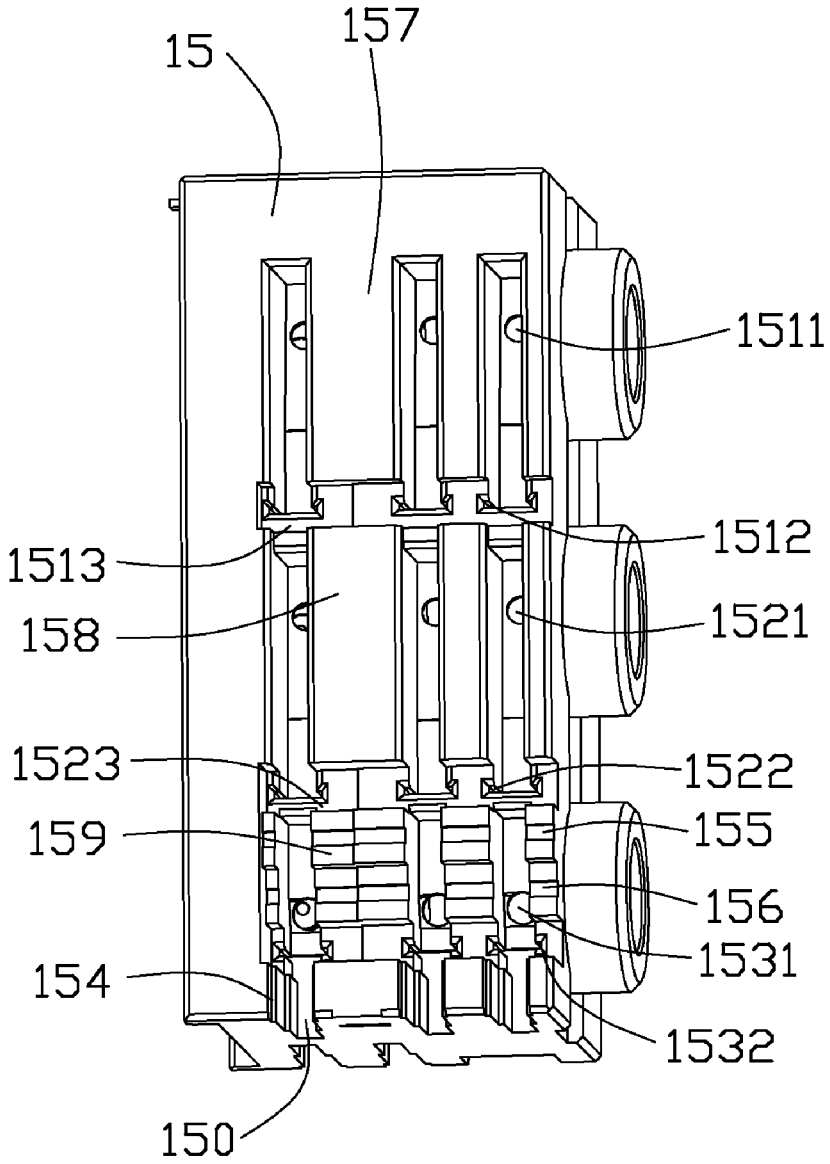
FIG. 7 is a perspective view of an insulative housing of the audio jack connector shown in FIG. 1.
Figure 8:
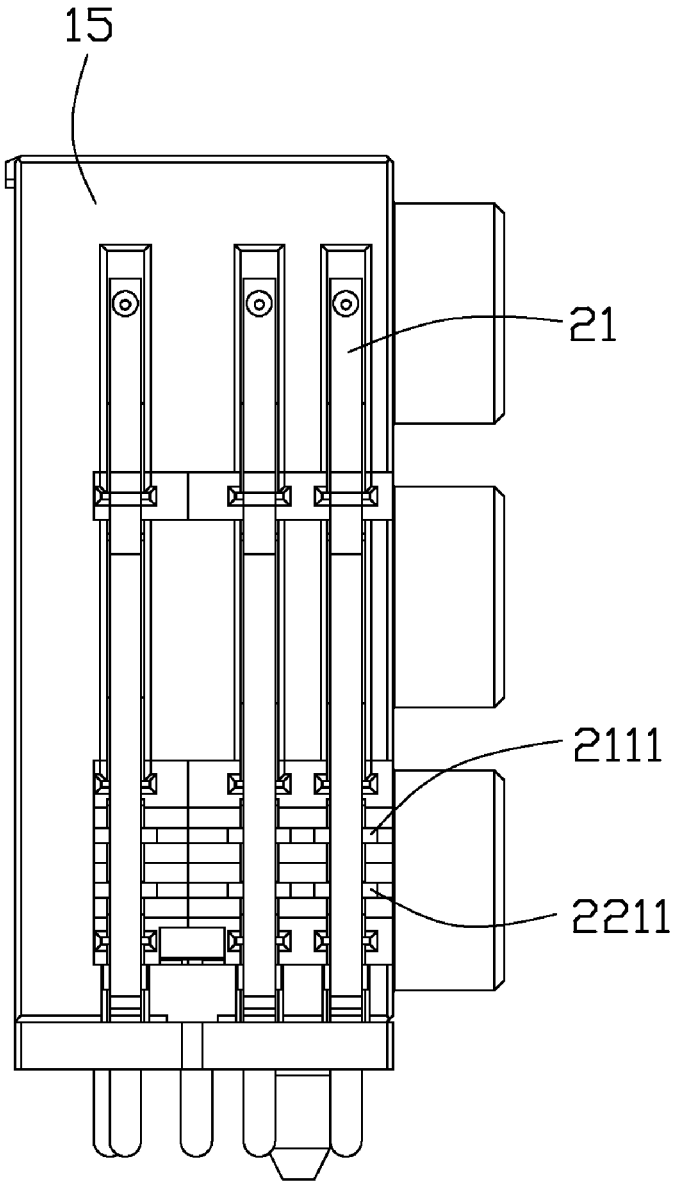
FIG. 8 is a left elevational view showing the contacts and detection switches assembled to the insulative housing.

Referring to FIGS. 4 and 5, the contacts 2 include a set of first contacts 21, a set of second contacts 22 and a set of third contacts 23 assembled to the left side wall 15 from an outer surface of the left side wall 15. The first contacts 21 have resilient first contacting portions 212 received in the first receiving slots 151 and defining first convex protrusions 2121 protruding through the first perforations 1511 and into the upper receiving chamber 111 for contacting with plug 200, first retaining portions 2112 extending horizontally from lower ends of the first contacting portions 212 and retained in the first retaining slots 1512, first connecting portions 211 extending downwardly from the first retaining portions 2112 and extending through the second and third receiving slots 152, 153, and first tail portions 213 bending inwardly from lower ends of the first connecting portions 211 and extending downwardly through the first grooves 150 for being mounted to PCB 300. Each first connecting portion 211 has a pair of first securing portions 2111 retained in the first securing slots 155 and a pair of first stopping portions 2113 resisted outwardly by the ribs 154. The second contacts 22 have resilient second contacting portions 222 received in the second receiving slots 152 and defining second convex protrusions 2221 protruding through the second perforations 1521 and into the middle receiving chamber 111 for contacting with the plug 200, second retaining portions 2212 extending horizontally from lower ends of the second contacting portions 222 and retained in the second retaining slots 1522, second connecting portions 221 extending downwardly from the second retaining portions 2212 and extending through the third receiving slots 153, and second tail portions 223 bending inwardly from lower ends of the second connecting portions 221 and extending downwardly through the first grooves 150 for being mounted to the PCB 300. Each second connecting portion 221 has a pair of second securing portions 2211 retained in the second securing slots 156. Each second tail portion 223 is located between the ribs 154. The third contacts 23 have resilient third contacting portions 232 received in the second receiving slots 152 and defining third convex protrusions 2321 protruding through the third perforations 1531 and into the lower receiving chamber 111 for contacting with the plug 200, third connecting portions 231 bending downwardly from upper ends of the third contacting portions 232 and extending through the third receiving slots 153, third retaining portions 2312 extending horizontally from lower ends of the third connecting portions 231 and retained in the third retaining slots 1532, and third tail portions 233 resisted inwardly by the ribs 154 and extending downwardly through the first grooves 150 for being mounted to the PCB 300. The first contacts 21, the second contacts 22, and the third contacts 23 are retained in the left side wall 15 and arranged in three rows along the transverse direction. The first, second, and third connecting portions 211 are retained on the left side wall 15, and there is no need a spacer for retaining them, a volume of the audio jack connector 100 is decreased.

Referring to FIGS. 4 and 5, the detection switches 3 include three detection switches 3 assembled to the right side wall 16 from an outer surface of the right side wall 16 and arranged in three rows along the transverse direction. The three detection switches 3 are substantially of the same configuration and are assembled to the first receiving cavities 161, the second receiving cavities 162, and the third receiving cavities 163 respectively. Each detection switch 3 includes a stationary contact 32 and a movable contact 31 for connecting or disconnecting with the stationary contact 32. The movable contacts 31 have moving portions 312 received in the receiving cavities 161, 162, 163, first positioning portions 316 retained in retaining cavities 165 formed below the receiving cavities 161, 162, 163, first extending portions 311 extending downwardly from the first positioning portions 316, and first soldering portions 313 bending inwardly from the first extending portions 311 and extending downwardly through the second grooves 167 for being mounted to the PCB 300. The stationary contacts 32 have immovable portions 322 received in the receiving cavities 161, 162, 163 and located at outer sides of the moving portions 311, second positioning portions 325 retained in the retaining cavities 165, second extending portions 321 extending downwardly from the second positioning portions 325, and second soldering portions 323 bending inwardly from the second extending portions 321 and extending downwardly through the second grooves 167 for being mounted to the PCB 300. Each moving portion 312 has an insulator 314 attached to an inner surface thereof for being resisted by the plug 200 and an embossment 315 integrally protruding from an outer surface thereof for contacting with the immovable portion 322. The insulator 314 could be integrally molded with the moving portion 312 or assembled to the moving portion 312. Therefore, the movable contact 31 is brought into or out of contacting with the stationary contact 32 with the plug 200 inserted into or extracted out of the receiving chamber 111 so as to detect the insertion of the plug 200. The first and second extending portions 311, 321 have fixing portions 3111 retained in securing cavities 166 which are formed on the right wall 16. The enforcing members 101 are located between the contacts 2 and the detecting switches 3 and resist the plugs 200 for optimizing insertion and extraction force of the plugs 200.

The spacer 4 is assembled to the lower face 14 of the main body 10 and has a set of first through holes 41 for retaining the first, second and third tail portions 213, 223, and 233, and a set of second through holes 42 for retaining the first and second soldering portions 313, 323. Therefore, the first, second and third tail portions 213, 223, and 233 extending through the lower face 14 to be mounted to the PCB 300 and will not occupy extra space of the PCB 300.

The shell 5 is assembled to the insulative housing 1 from a front side of the insulative housing 1 and includes a front plate 51 defining three openings 511 for the columnar bushing 18 passing therethrough, a pair of side plates 52 extending backwardly from the front plate 51, and a top plate 53 connecting the side plates 52. A set of board locks 522 are formed on the side plates 52 for being mounted to the PCB 300. The rear cover 6 is assembled to the rear face 12 of the insulative housing 1 and has a set of gaps 61 for latching with barbs 521 formed on the shell 5.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An audio jack connector comprising:

an insulative housing having a main body defining a pair of opposite front and rear faces and a pair of opposite first and second side walls, a set of columned mating portions extending forwardly on the front face, and a set of receiving chambers extending in the main body and passing through the mating portions for insertion of plugs;

a plurality of contacts retained in the first side wall and arranged in several different rows along a transverse direction so as to protrude into the receiving chambers respectively, each row of the contacts being arranged along a front-to-back direction in accordance with an insertion direction of the plug and perpendicular to the transverse direction; and a plurality of detection switches retained in the second side wall and arranged in several different rows along the transverse direction;

wherein the detection switch comprises a stationary contact defining an immovable portion, and a movable contact defining a moving portion located at an inner side of the immovable portion for connecting or disconnecting with the immovable portion;

wherein the moving portion has an insulator attached to an inner surface thereof for being resisted by the plug, and an embossment protruding from an outer surface thereof for contacting with the immovable portion.

2. The audio jack connector according to claim 1, wherein the first side wall has a set of receiving slots arranged in several rows along a height direction of the audio jack connector and communicating with the receiving chamber, the contacts comprise contacting portions disposed on different height with the contacts in the different rows for being received in the receiving slots and protruding into the receiving chamber to contact with the plugs.

3. The audio jack connector according to claim 2, wherein the first side wall has a set of perforations formed thereon, the receiving slots communicate with the receiving chamber via the perforations, the contacting portions define convex protrusions passing through the perforations and protruding into the receiving chamber for contacting with the plugs and did not have any other portions protruding into the receiving chamber.

4. The audio jack connector according to claim 2, wherein the first side wall has a set of retaining slots located below the corresponding receiving slots and communicating with the receiving slots, the contacts comprise retaining portions extending horizontally and located on different heights with the contacts in the different rows for being retained in the retaining slots.

5. The audio jack connector according to claim 4, wherein the contacts comprise connecting portions extending downwardly along the insulative housing and disposed on different positions along the transverse direction with the contacts in the different rows, and tail portions extending downwardly and disposed on different positions along the transverse direction with the contacts in the different rows for being mounted to the PCB, all of the tail portions are located at an inner side of an outer surface of the first side wall.

6. The audio jack connector according to claim 5, wherein the closer the connecting portions are to the outer surface, the longer the connecting portions are along the height direction.

7. The audio jack connector according to claim 5, wherein the first side wall has a set of grooves passing downwardly through a lower face of the insulative housing for the tail portions extending through and a set of ribs located at two sides of each groove for keeping the tail portions in different positions.

8. The audio jack connector according to claim 5, wherein the audio jack comprises a spacer assembled to a lower face of the insulative housing, the tail portions extending downwardly through the lower face and retained in through holes formed on the spacer.

9. The audio jack connector according to claim 1, wherein the audio jack connector comprise a plurality of enforcing members extending along the front-to-back direction and located between the contacts and the detection switches, the enforcing member protrudes upwardly into the receiving chambers respectively for resisting the plug upwardly so as to optimize the insertion and extraction force of the plug.

10. The audio jack connector according to claim 1, wherein the main body has a pair of recesses recessed backwardly from the front face and located at upper and lower sides of each mating portion, the audio jack comprises a plurality of columnar bushings assembled to the main body, each columnar bushing has a pair of projections retained in the recesses.

11. A stacked audio jack connector comprising: an insulative housing having a main body defining a pair of opposite front and rear faces and a pair of opposite first and second side walls, a set of columned mating portions extending forwardly on the front face and stacked in a row along a height direction of the audio jack connector, and a set of receiving chambers extending in the main body and passing through the mating portions for insertion of plugs; and a plurality of contacts assembled to the first side wall from an outer surface of the first side wall, the contacts including a set of longest contacts arranged in an outmost row along a front-to-back direction and defining highest contacting portions projecting into a highest receiving chamber for contacting with the plug, a set of lowest contacts arranged in an innermost side row along the front-to-back direction and defining lowest contacting portions projecting into a lowest receiving chamber for contacting with the plug, and a set of middle contacts arranged in a middle row along the front-to-back direction and located between the outmost row and the innermost row, the middle contacts defining middle contacting portions projecting into a middle receiving chamber for contacting with the plug and located between the highest contacting portions and the lowest contacting portions in the height direction; and a plurality of detection switches assembled to the second side wall from an outer surface of the second side wall; the detection switches include a highest detection switch located at an outmost side and protruding into the highest chamber, a lowest detection switch located at an innermost side and protruding into the lowest chamber, and a middle detection switch located between the highest detection switch and the lowest detection switch in the height direction and protruding into the middle chamber;

wherein each detection switch comprises a stationary contact defining an immovable portion, and a movable contact defining a moving portion located at an inner side of the immovable portion for connecting or disconnecting with the immovable portion, the moving portion has an insulator attached to an inner surface thereof of being resisted by the plug, and an embossment integrally protruding from an outer surface thereof for contacting with the immovable portion.

12. An electrical connector for mounting upon a printed circuit board, comprising:

an insulative housing defining a plurality of mating ports stacked upon one another in a vertical direction while each of said mating port extending in a front-to-back direction with a front opening communicating with an exterior for receiving a columnar stiff plug therein, each of said mating port on at least one transverse side equipped with a plurality of resilient contacts arranged generally in the front-to-back direction for respectively contacting different axial positions of the corresponding plug, while each of said resilient contacts being deflectable, during mating with the corresponding columnar stiff plug, in a transverse direction perpendicular to both said vertical direction and said front-to-back direction; and the contacts of the different mating ports, which are operated with the mating plugs at the same axial position, having corresponding tail sections arranged in one row in said transverse direction;

wherein the tail sections in said one row in the transverse direction include an outermost one which belongs to the mating port farther from the printed circuit board than others, and an innermost one which belongs to the mating port nearer to the printed circuit board than others;

wherein in each mating port, the contacts on the same transverse side are essentially same with one another while the contact which is farthest from the front opening is closer to a centerline of the mating port than others for efficiently mating with a distal end region of the mating plug.

13. The electrical connector as claimed in claim 12, wherein the tail sections the contacts belonging to the different mating ports while arranged in said one row in said transverse direction, are respectively equipped with L-shaped bottom end region for mounting to the printed circuit board under condition that the L-shaped bottom end of the contact belonging to the mating port farthest from the printed circuit board is located outer and dimensioned shorter than others.

* * * * *